United States Patent [19]

Brown

[11] Patent Number: 4,907,500

[45] Date of Patent: Mar. 13, 1990

[54] ONE-PIECE LEVER FOR MULTI-LOUVERED DAMPER

[75] Inventor: Douglas S. Brown, Knoxville, Tenn.

[73] Assignee: American Metal Products Company, Los Angeles, Calif.

[21] Appl. No.: 314,732

[22] Filed: Feb. 23, 1989

[51] Int. Cl.[4] ..... F24F 13/15

[52] U.S. Cl. ..... 98/110; 98/41.1

[58] Field of Search ..... 98/41.1, 107, 110, 121.2

[56] References Cited

U.S. PATENT DOCUMENTS

| | | | |
|---|---|---|---|
| 113,447 | 4/1871 | Phinney | 98/110 |
| 131,459 | 9/1872 | Phinney | 98/110 |
| 672,765 | 4/1901 | Hart | 98/110 |
| 702,936 | 6/1902 | Fox | 98/110 |
| 2,503,421 | 4/1950 | Sherard . | |
| 2,837,019 | 6/1958 | Godes . | |
| 3,500,739 | 3/1970 | Dry | 98/110 |
| 3,552,295 | 1/1971 | Armstrong | 98/110 |
| 3,676,795 | 4/1954 | De Roo | 98/110 X |
| 3,683,786 | 8/1972 | Hedrick | 98/110 |
| 3,738,254 | 6/1973 | Root | 98/119 |
| 3,780,640 | 12/1973 | Fruth | 98/110 |
| 3,938,430 | 2/1976 | Koppang | 98/103 |
| 4,653,384 | 3/1987 | Amano | 98/40.3 |

FOREIGN PATENT DOCUMENTS

| | | | |
|---|---|---|---|
| 2262307 | 7/1973 | Fed. Rép. of Germany | 98/110 |

*Primary Examiner*—Harold Joyce

*Attorney, Agent, or Firm*—Edgar A. Zarins; Malcolm L. Sutherland

[57] ABSTRACT

A one-piece damper lever for a multi-louvered damper of the type mountable within a duct opening formed in a floor, wall or ceiling. The lever is used to pivot louvers between an open and closed position in order to control the flow of air through the damper. The lever is pivotable to a low-profile position such that it rests substantially coplanar with the damper face. The one-piece construction eliminates assembly following installation and the low profile reduces damage during shipping as well as providing a streamlined appearance to the damper grill.

11 Claims, 1 Drawing Sheet

ONE-PIECE LEVER FOR MULTI-LOUVERED DAMPER

BACKGROUND OF THE INVENTION

I. Field of the Invention

This invention relates to a lever for controlling the pivotable louvers of a damper vent and, in particular, to an operating lever for a multi-louvered damper which is of one piece construction to eliminate assembly upon installation and which can be pivoted to a low-profile position substantially coplanar with the damper face thereby eliminating any extruding components which can cause damage during shipment and generally detracts from the overall appearance of the damper vent.

II. Description of the Prior Art

Registers mounted in the floor or wall of a room have been used to control the flow of air into the room from a duct. Typically, such registers include a plurality of rotatable directional vanes which are used to direct the air flow or to close the register opening to prevent air flow. In the past the directional vanes or louvers have been moved by means of a multiple component lever arm which extends outwardly beyond the face of the register. The louvers are connected to a bar such that rotation of one vane will simultaneously rotate the full bank of vanes within the register. These prior known two-piece pivotable operating levers required assembly upon installation of the register by placing the cap portion of the lever onto the body. The two piece construction was necessary to facilitate shipping since the assembly lever extended so far outwardly beyond the face of the register as to hinder stacking of the registers. However, the cap has been found to be difficult to insert on the lever and could be removed and lost or swallowed by small children. Nevertheless, the two-piece pivotable operating lever operated efficiently because of the leverage provided by the pivoting action which allowed the damper to be easily opened and closed.

Non-pivoting operating levers also have been used to rotate the louvers or vanes of a damper. Such operating levers depended upon a linear sliding handle which were connected to the vanes in such a manner as to cause them to rotate. However, because the lever does not pivot additional components are required to cause the louvers to rotate. Moreover, the leverage of pivoting operating levers is lost which may make it difficult to open and close the register.

SUMMARY OF THE PRESENT INVENTION

The present invention overcomes the disadvantages of the prior known operating lever by providing a low profile, one piece pivoting lever to operate the vanes of a damper register.

The operating lever embodying the present invention is a pivotable lever to control the motion of the vanes which generally comprises a thumb engaging portion and an extension arm connected to the pivot bar for rotating the directional louvers. The lever has an aperture for connecting the lever to the register and which forms the pivot axis. The thumb engaging portion includes a thumb recess to facilitate pivoting and extends substantially flush with the register face when the lever and louvers are in a first position. The thumb engaging portion has a triangular configuration such that upon depressing a first corner of the thumb portion the opposite corner is raised above the face of the register. To completely open the vanes, the second corner can thereafter be grasped and pivoted. Thus, the operating lever of the present invention provides a low profile substantially flush with the register face in a first position yet can be easily pivoted to rotate the louvers of the damper.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views, and in which.

DETAILED DESCRIPTION OF A PREFERRED EMBODIMENT OF THE PRESENT INVENTION

Figure 1:
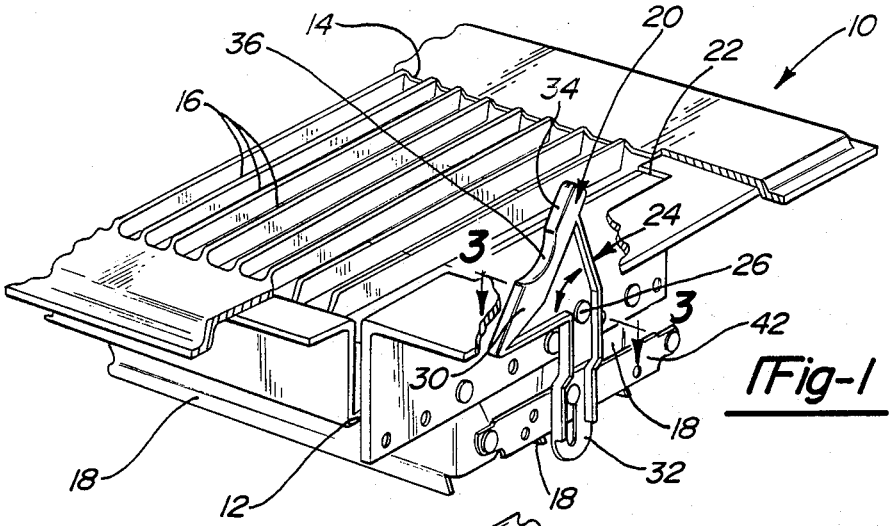
FIG. 1 is a partial elevated perspective of a multi-louvered damper embodying the operating lever of the present invention.
Figure 2:
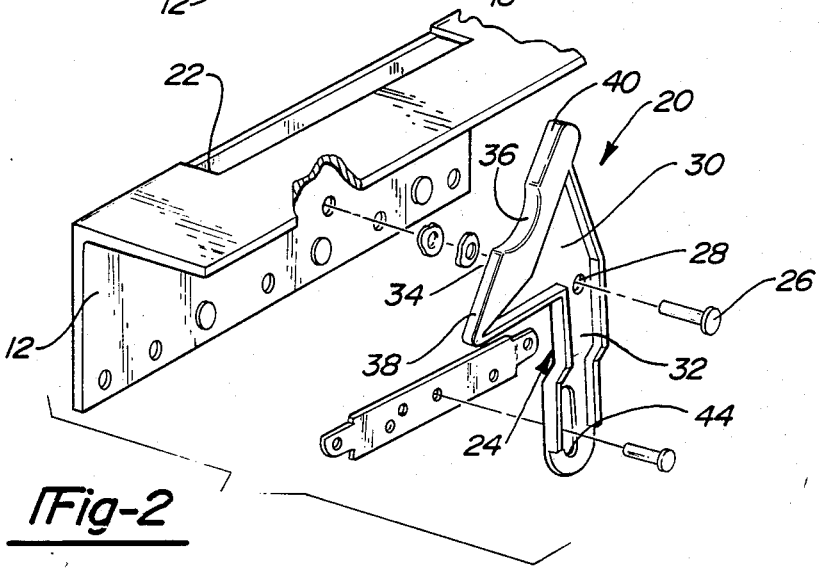
FIG. 2 is an exploded view of the operating lever of the present invention as it is attached to the damper.
Figure 3:
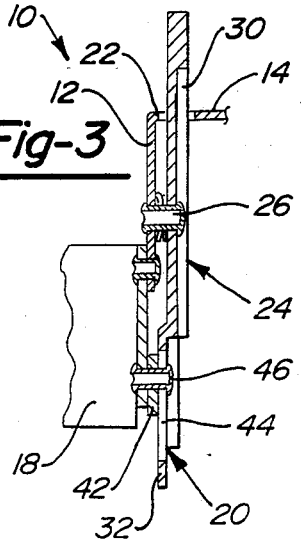
FIG. 3 is a cross-sectional perspective of the operating lever taken along line 3—3 of FIG. 1.
Figure 4:
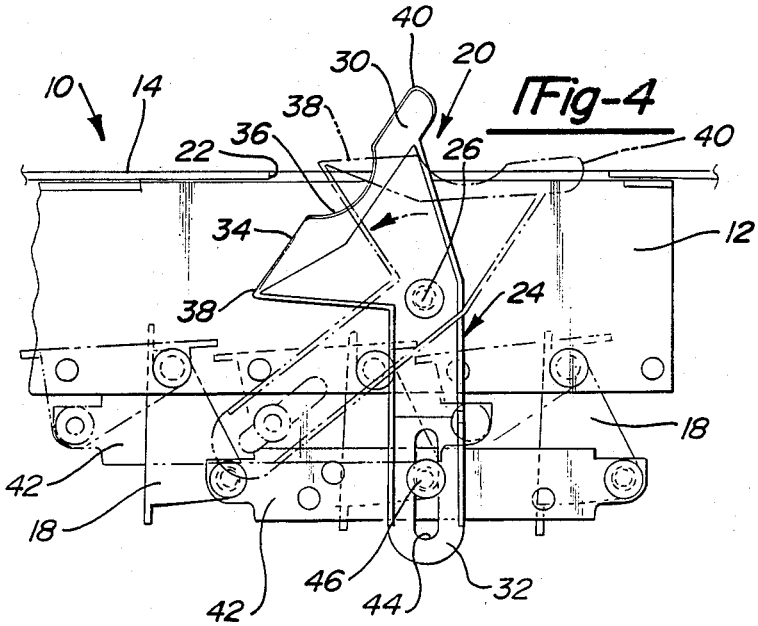
FIG. 4 is a side plan view of the operating lever mounted to the damper showing in phantom the lever in a first extreme position and in solid the lever pivoted to a second extreme position.

Referring first to FIG. 1, there is shown a portion of a register/damper 10 embodying the present invention. The damper 10 is of the type used to control air flow from a duct and generally comprises a rectangular frame 12 and an outer face 14 incorporating a plurality of directional slots 16 through which the air flows. The damper 10 is normally mounted within an opening in the duct to control the air flow. The damper 10 also includes a plurality of rotatable louvers 18 pivotably fastened to the frame 12 which operate to direct the air flow through the damper 10 or to prevent air flow through the damper 10 as desired. The position of the louvers 18 is controlled by an operating lever 20 embodying the present invention. In a preferred embodiment, the operating lever 20 is disposed within an elongated slot 22 formed along one edge of the damper frame 12 and face 14 to allow access by the user once the damper 10 is mounted to the duct opening.

Referring now to FIGS. 1 through 4, the operating lever 20 of the present invention comprises an integral body 24 pivotably mounted to the damper frame 12 by a pivot pin 26 which extends through a pivot aperture 28 in the body 24. The body 24 includes an engagement portion 30 integrally formed with an extension arm 32. The integral formation of the body 24 eliminates the need for any final assembly of the operating lever 20 upon installation of the damper 10 as well as preventing added components from becoming lost. Moreover, operating lever 20 can be positioned such that it does not extend outwardly from the face 14 of the damper 10 as will be subsequently described.

The engagement portion 30 of the body 24 preferably has a triangular configuration with the pivot aperture 28 formed at one apex of the triangle and an engagement edge 34 forming a side of the triangle opposite from the pivot aperture 28. The engagement edge 34 preferably includes a thumb recess 36 to facilitate manipulation of the operating lever 20 by the user. The operating lever 20 is positioned within the slot 22 such that the engagement edge 34 is accessible. The engagement edge 34 includes a first end 38 which is inwardly movable to pivot the body 24 in a first direction and a second outwardly movable end 40. The thumb recess 36 is formed intermediate the ends 38 and 40.

The integral extension arm 32 extends from the apex of the engagement portion 30 having the pivot aperture 28. The arm 32 is slidably connected to a connecting bar 42, which, in turn, is secured to the bank of louvers 18 for simultaneous movement of the louvers 18. The extension arm 32 includes a longitudinal slot 44 which slidably receives a connecting pin 46 of the connecting bar 42. The extension arm 32 is slidably connected to the bar 42 in a manner such that as the body 24 pivots about pin 26 the connecting bar 42 will move longitudinally to simultaneously move the louvers 18. The slot 44 accommodates lateral movement of the connecting bar 42 as the body 24 pivots.

Operation of the present invention facilitates simple and efficient manipulation of the louvers 18 of the damper 10 while providing a low profile operating lever 20 which is aesthetically pleasing and unobtrusive. The operating lever 20 is movable between a first position (shown in phantom in FIG. 4) wherein the louvers 18 prevent air flow through the damper and a second position (solid in FIG. 4) to fully open the louvers 18. In the first or closed position, the engagement edge 34 of the lever body 24 is substantially parallel to the damper face 14 and therefore does not extend outwardly from the damper face 14. To open the damper 10, the first end 38 of the engagement edge 34 is depressed inwardly which simultaneously pivots the second end 40 of the edge 34 outwardly. To manipulate the louvers 18 to direct the air flow, the second end 40 is grasped by the user to pivot the integral body 24. As the body 24 is pivoted about pin 26 the connecting bar 42 will be moved accordingly which in turn will rotate the bank of louvers 18. In a preferred embodiment, moving the lever 20 to the first flush position (phantom) will rotate the louvers 18 parallel to the damper face 14 closing the damper 10. As the lever 20 is moved towards the second position (solid) the direct perpendicular flow path through the damper 10 will become less obstructed.

Thus, the operating lever of the present invention provides a low profile when in the closed position which facilitates stacking, storage and/or packaging of the dampers since no outwardly extending lever is present to damage the adjacent damper. The dissimilar positions of lever also give a clear visual indication of when the damper is closed or open. Finally, the integral construction of the lever body simplifies manufacture and assembly and ensures that the separation of key components will not occur.

The foregoing detailed description has been given for clearness of understanding only and no unnecessary limitations should be understood therefrom as some modifications will be obvious to those skilled in the art without departing from the scope and spirit of the appended claims.

I claim:

1. An operating lever for a multi-louvered damper, said damper including a frame, an outer face and a plurality of rotatable louvers simultaneously movable between first and second positions to control the air flow through the damper, said operating lever comprising:

an integral body having an engagement portion and an extension arm, said engagement portion having a substantially triangular configuration with an engagement edge forming one side of said triangle and said arm extending from an apex of said triangle opposite from said engagement edge, said body pivotably mounted to the damper frame for movement between a first lever position wherein the plurality of louvers are in their first position and said engagement edge is substantially flush with the damper face so as not to protrude beyond the damper face and a second lever position wherein the plurality of louvers are in their second position and said engagement edge is disposed at an angle to the damper face thereby providing a visual indication that the louvers are in their second position; and means for connecting said extension arm of said integral body to the plurality of louvers for simultaneous movement of the louvers such that as said body pivots between the first lever position and the second lever position the louvers simultaneously move between the first and second positions to vary the air flow through the damper.

2. The operating lever as defined in claim 1 wherein said connecting means includes a connecting bar pivotably attached to the plurality of louvers for simultaneous movement of the louvers, said connecting bar slidably attached to said extension arm for longitudinal movement as said body pivots.

3. The operating lever as defined in claim 1 wherein said engagement edge includes a first end, a second end, and thumb recess formed therebetween, said first end being depressed inwardly to pivot said body from said first lever position thereby moving said second end outwardly from the damper face.

4. The operating lever as defined in claim 3 wherein said pivotable body is disposed within a slot formed in the damper frame.

5. The operating lever as defined in claim 2 wherein said extension arm includes a longitudinal slot, said slot slidably receiving a connecting pin secured to said connecting bar whereby upon pivoting movement of said extension arm in response to movement of said body between said first and second positions, said connecting bar is longitudinally displaced to simultaneously move the louvers.

6. The operating lever as defined in claim 1 wherein the louvers are open in their second position to allow air flow through the damper, said second lever position providing a visual indication that said louvers are open to permit air flow through the damper.

7. In a damper having a frame, an outer face and a plurality of rotatable louvers simultaneously movable between first and second positions to control the air flow through the damper, an operating lever for moving the louvers between the first and second positions, said operating lever comprising:

an integral body having an engagement portion and an extension arm, said body pivotably mounted to the damper frame and positioned wthin a slot formed in the damper frame, said engagement portion of said body having a substantially triangular configuration, said extension arm extending from one apex of said triangle and an engagement edge forming a side of said triangle opposite from said one apex; and a connector bar pivotably connected to the plurality of louvers and slidably connected to said extension arm of said body for simultaneously moving the louvers as said body pivots between a first and a second position;

said engagement edge positioned substantially flush with the damper face in said first body position whereby no portion of said operating lever extends outwardly beyond the damper face and said engagement edge disposed at an angle to the damper face when said body is pivoted to said second body position providing a visual indication that the louvers are in their second position.

8. The operating lever as defined in claim 7 wherein said body is pivotably mounted to the damper frame by a pivot pin extending through a pivot aperture in said body, said pivot aperture formed at said one apex of said engagement portion such that said extension arm connected to said connector bar extends in a first direction from said pivot aperture and said engagement portion extends in an opposite direction from said pivot aperture.

9. The operating lever as defined in claim 7 wherein said engagement edge includes a substantially semi-circular thumb recess to facilitate pivoting of said body.

10. The operating lever as defined in claim 7 wherein said extension arm includes a longitudinal slot, said slot slidably receiving a connecting pin secured to said connecting bar whereby upon pivoting movement of said extension arm in response to movement of said body between said first body position and said second body position said connecting bar is longitudinally displaced to simultaneously move the plurality of louvers.

11. An operating lever for a multi-louvered damper, said damper including a frame, an outer face and a plurality of rotatable louvers simultaneously movable between first and second positions to control the air flow through the damper, said operating lever comprising:

an integral body having an engagement portion and an extension arm, said body positioned within a slot formed in the damper frame, said engagement portion of said body having a substantially triangular configuration, said body pivotably mounted to the damper frame by a pivot pin extending through a pivot aperture formed at one apex of said body, said extension arm extending from said one apex of said triangle, a linear engagement edge formed a side of said triangle opposite said one apex, said engagement edge including a semi-circular thumb recess; and a connector bar pivotably connected to said extension arm of said body for simultaneously moving the louvers as said body pivots between a first and a second position, said extension arm including a longitudinal slot, said slot slidably receiving a connecting pin secured to said connecting bar such that upon pivoting movement of said extension arm in response to movement of said connecting pin slides along said slot thereby maintaining alignment of said body within the slot of the damper frame;

said engagement edge positioned substantially flush with the damper face in said first body position whereby no portion of said operating lever extends outwardly beyond the damper face and said engagement edge disposed at an angle to the damper face when said body is pivoted to said second body position providing a visual indication that the louvers are in their second position.

* * * * *